US008485005B2

(12) United States Patent
Tsai

(10) Patent No.: US 8,485,005 B2
(45) Date of Patent: Jul. 16, 2013

(54) COMPUTER LOCK

(75) Inventor: Chin-Hui Tsai, Changhua (TW)

(73) Assignee: Handyway Co., Ltd., Changhua (TW)

( * ) Notice: Subject to any disclaimer, the term of this patent is extended or adjusted under 35 U.S.C. 154(b) by 154 days.

(21) Appl. No.: 13/034,877

(22) Filed: Feb. 25, 2011

(65) Prior Publication Data

US 2012/0216581 A1 Aug. 30, 2012

(51) Int. Cl.

| | |
|---|---|
| ***E05B 69/00*** | (2006.01) |
| ***E05B 73/00*** | (2006.01) |
| ***E05B 65/00*** | (2006.01) |
| ***E05B 13/02*** | (2006.01) |
| ***E05B 27/00*** | (2006.01) |

(52) U.S. Cl.
USPC ..... 70/58; 70/14; 70/57; 70/424; 70/492

(58) Field of Classification Search
USPC ..... 70/14, 18, 49, 57, 58, 423, 424, 427–430, 70/492; 248/551–553
See application file for complete search history.

(56) References Cited

U.S. PATENT DOCUMENTS

| | | | | |
|---|---|---|---|---|
| 5,913,907 | A * | 6/1999 | Lee | 70/58 |
| 6,205,824 | B1 * | 3/2001 | Miao | 70/58 |
| 6,591,642 | B1 * | 7/2003 | Kuo | 70/58 |
| 6,886,376 | B2 * | 5/2005 | Kuo | 70/58 |
| 6,971,254 | B2 * | 12/2005 | Bellow et al. | 70/14 |
| 7,100,404 | B2 * | 9/2006 | Murray et al. | 70/58 |
| 7,111,479 | B2 * | 9/2006 | Murray et al. | 70/58 |
| 7,409,842 | B2 * | 8/2008 | Kuo | 70/58 |
| 2006/0081021 | A1 * | 4/2006 | Merrem et al. | 70/58 |
| 2008/0178647 | A1 * | 7/2008 | Calor | 70/237 |
| 2010/0139337 | A1 * | 6/2010 | Hung et al. | 70/58 |
| 2010/0180648 | A1 * | 7/2010 | Knox | 70/58 |
| 2010/0192642 | A1 * | 8/2010 | Hung et al. | 70/58 |
| 2011/0013361 | A1 * | 1/2011 | White et al. | 361/679.55 |

* cited by examiner

*Primary Examiner* — Christopher Boswell
*Assistant Examiner* — Eric Kurilla
(74) *Attorney, Agent, or Firm* — Rosenberg, Klein & Lee

(57) ABSTRACT

The present invention discloses a computer lock including a lock body, a guide seat, a lock tongue seat, a spring, a hook cylinder, and a cable rope set. The hook cylinder has a hook part extending outwards from the front end thereof. The hook part is arranged at inner wall of a slot of a computer; by lock actuation of a key, the guide seat is actuated to guide the lock tongue of the lock tongue seat to outstretch forward and enter the slot along the guide groove on the front end of the hook cylinder. By the foregoing mechanism, the computer lock is of being easy operation and can be locked and unlocked conveniently to prevent the computer from being stolen.

7 Claims, 6 Drawing Sheets

COMPUTER LOCK

BACKGROUND OF THE INVENTION

1. Field of the Invention

The present invention relates to a computer lock, and more particularly to a computer lock that is capable of being easily locked and operated in order to prevent the computer from being stolen.

2. Brief Description of the Related Art

The laptop computer has became more and more common; at public places such as library, coffee shop, office, or meeting room the laptop computer are used very frequently. This electronic device is not only expensive, but also stores valuable data inside; once it is stolen, it will cause serious inconvenience and great loss. In public, the laptop computer is under the risk of being stolen even when the user is only away from the table for a few minutes. Therefore, there are computer lock products entering the market to prevent stealing. The computer locks are mostly patented, such as prior arts of U.S. Pat. No. 5,493.878 and U.S. Pat. No. 7,100,403 (hereinafter the prior art.)

The lock actuation of the prior art is mainly of a crossmember 11 of a lock body's front end inserting into a rectangular slot 12 disposed on a computer 10's casing, as illustrated in FIG. 1, and rotating the key to actuate the crossmember 11 to turn 90 degrees and be of a perpendicular position with the slot 12, then synchronously actuating a pair of parallel pins 13 to hold the crossmember 11 at the two sides thereof respectively. As shown in FIG. 2, by the foregoing mechanism, the prior art is capable of locking and clamping and thereby prevents the computer from being stolen. However, the foregoing prior art has the following problems:

1. As the user holds the lock body with one hand and inserts the crossmember 11 into the slot 12, another hand is required to rotate the key to actuate the crossmember 11 to turn 90 degrees, and thereby actuates the pair of parallel pins 13 to outstretch forward and hold the crossmember 11 at the two sides thereof respectively. During the rotating process there is no component holding the slot 12 in place, and therefore it is difficult for the slot 12 to maintain the perpendicular position with the lock body. And with the situation like that, the outstretched pins 13 are stuck at the outside of the slot 12, and the user has to adjust the inserting angle and relock it all over again.
2. For the users not familiar with the lock operation, when they meet the situation as described in the foregoing problem 1, they often force the pins 13 to move inwards. This may cause damage to the peripheral edge of the slot 12 and bigger space around the slot 12 while being locked, and thereby leads to a bigger risk of being pried open.

SUMMARY OF THE INVENTION

In order to overcome the deficiencies of the prior art, a primary object of the present invention is to provide a computer lock that is capable of being easily locked and operated in order to prevent the computer from being stolen.

With the above object in mind, the present invention provides a computer lock comprising a lock body, a guide seat, a lock tongue seat, a spring, a hook cylinder, and a cable rope set. The hook cylinder has a hook part extending outwards from the front end thereof The hook part is arranged at inner wall of a slot of a computer; by lock actuation of a key, the guide seat is actuated to guide the lock tongue of the lock tongue seat to outstretch forward and enter the slot along the guide groove on the front end of the hook cylinder. By the foregoing mechanism, the computer lock is of being easy operation and can be locked and unlocked conveniently to prevent the computer from being stolen.

BRIEF DESCRIPTION OF THE INVENTION

The detail structure, the applied principle, the function and the effectiveness of the present invention can be more fully understood with reference to the following description and accompanying drawings, in which.

DETAILED DESCRIPTION OF THE PREFERRED EMBODIMENTS

Figure 2:
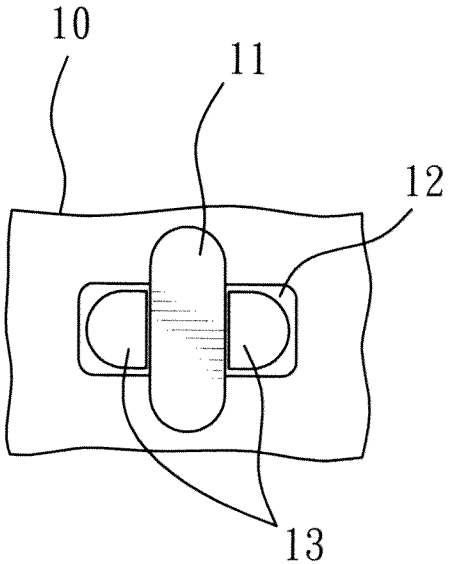
FIG. 2 PRIOR ART
FIG. 2 is a second schematic representation of a locked computer lock according to the prior art.
Figure 1:
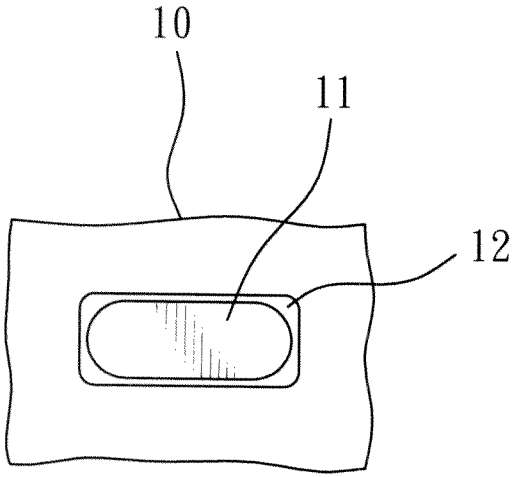
FIG. 1 PRIOR ART
FIG. 1 is a first schematic representation of a locked computer lock according to the prior art.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

Figure 3:
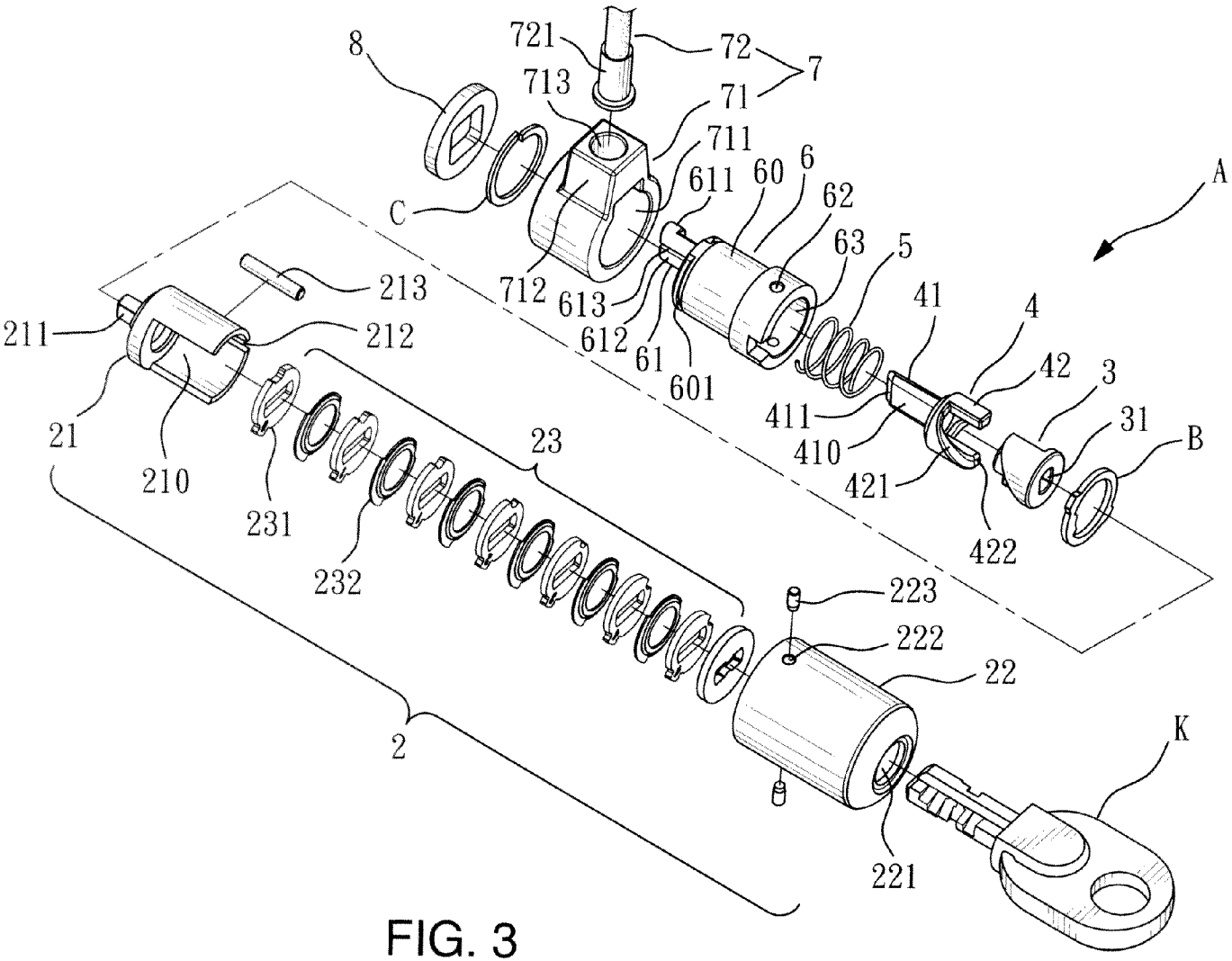
FIG. 3 is an exploded perspective view of the present invention.
Figure 4:
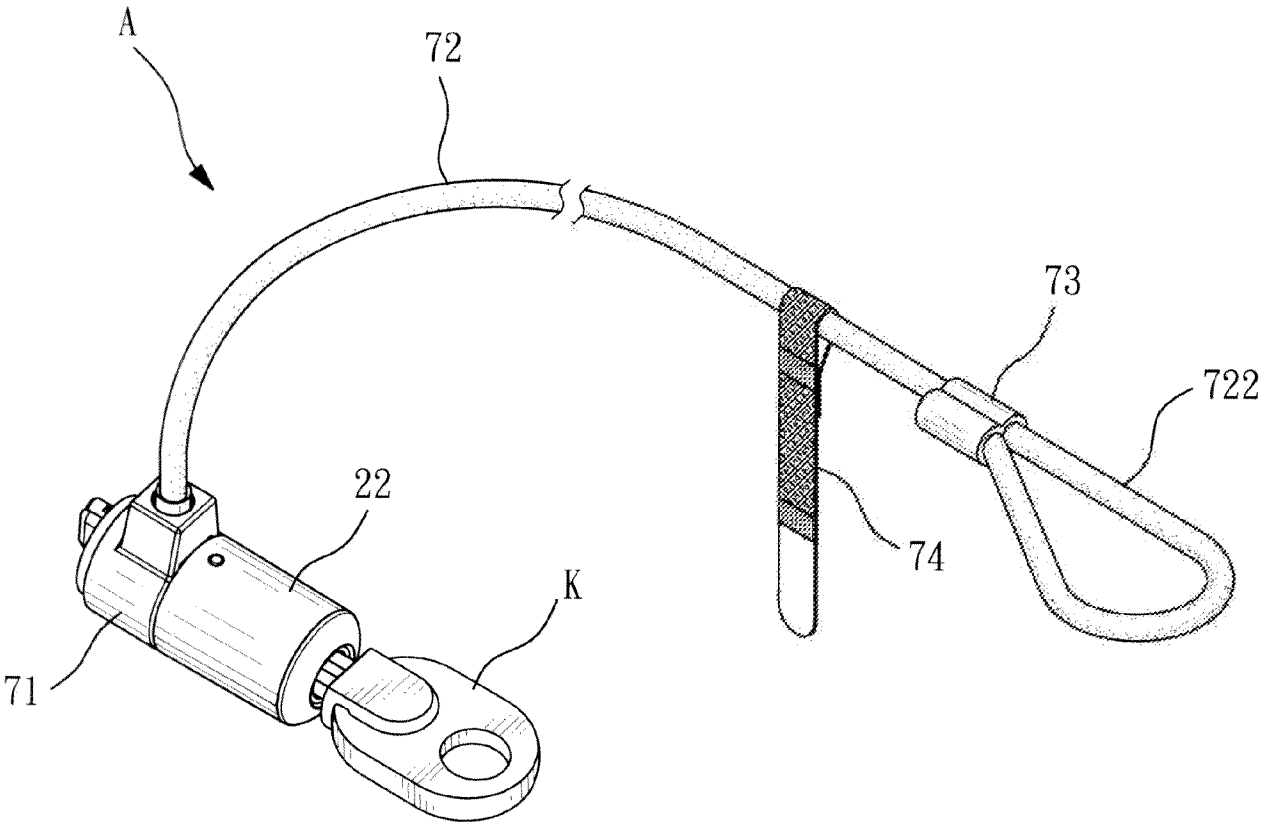
FIG. 4 is a perspective view of the present invention.

With reference to FIGS. 3 and 4, the computer lock A of the present invention comprises at least one lock body 2, one guide seat 3, one lock tongue seat 4, one spring 5, one hook cylinder 6 and one cable rope set 7. By the assembling of the foregoing assemblies, the present invention is capable of preventing the computer from being stolen.

Figure 5:
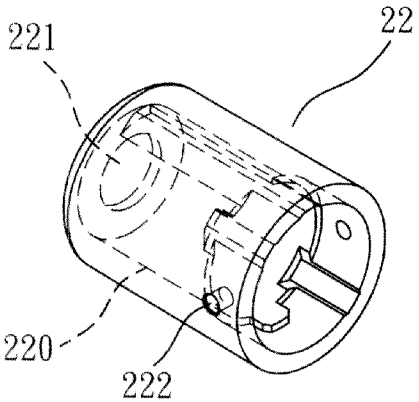
FIG. 5 is a perspective view of the lock casing according to the present invention.
Figure 9:
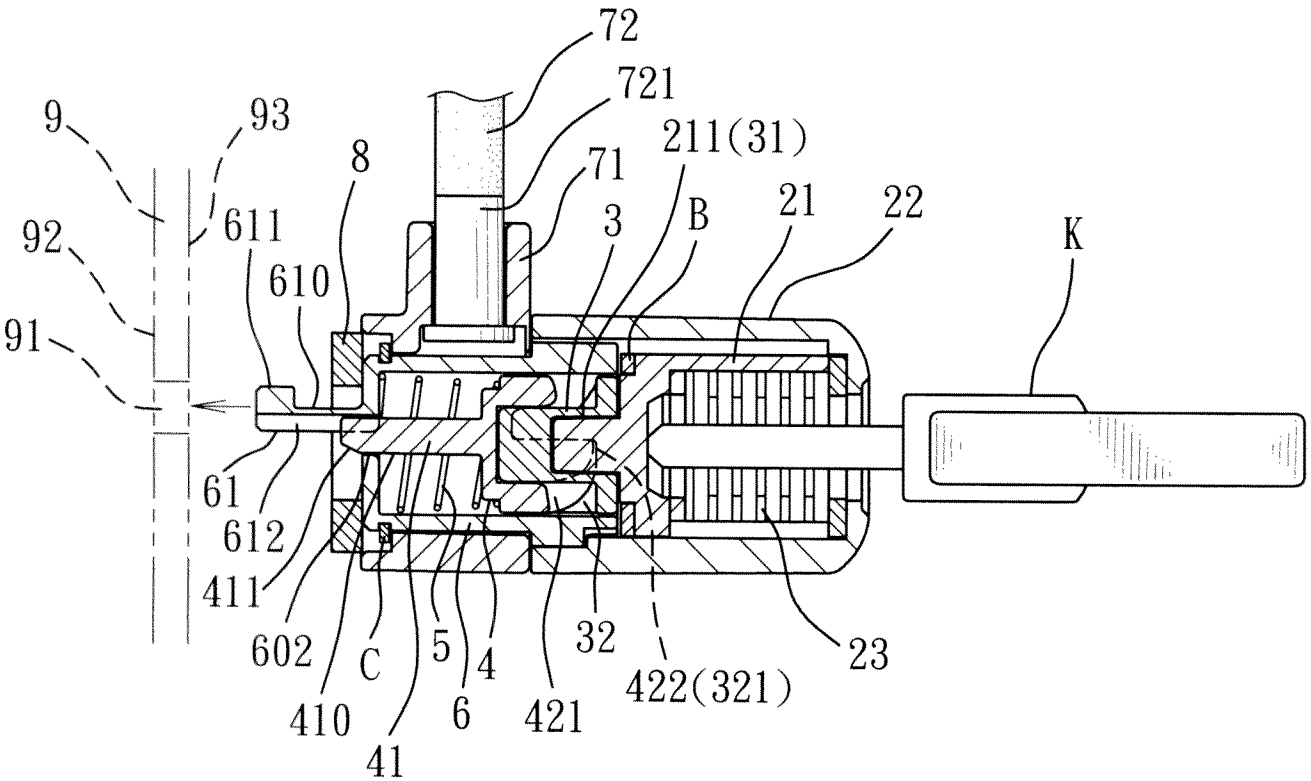
FIG. 9 is a first operating view of the present invention.

The lock body 2 comprises a lock core 21, a lock casing 22 and a lock control set 23. A lock control chamber 210 is disposed inside the lock core 21 to contain the lock control set 23. The lock core 21 fits with an inner chamber 220 disposed inside the lock casing 22, wherein a position-limiting ring B is used to limit the rotating position of the lock core 21, as shown in FIGS. 5 and 9. The front side of the lock core 21 is further disposed of a shifting rod 211, and the peripheral edge of the lock core 21 has a slit 212 to allow insertion of a position-limiting piece 213 in order to hold the lock control set 23. The lock casing 22 provides a keyhole 221 at one side thereof to allow insertion of a key K in order to control the lock and unlock action of the lock control set 23. The peripheral edge of the lock casing 22 is further disposed of at least one first pin hole 222 to allow insertion of at least one pin 223. The lock control set 23 is comprised of a plurality of lock plates 231 and a plurality of position-limiting plates 232. The structure and actuation of the lock body 2 are of conventional skills and are therefore not described in details hereinafter.

Figure 6:
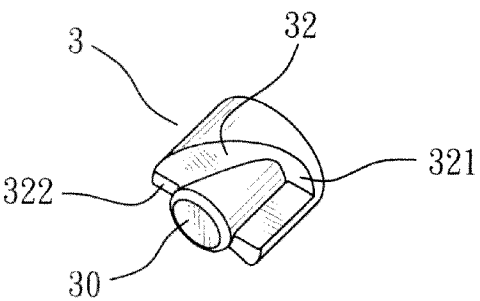
FIG. 6 is a perspective view of the guide seat according to the present invention.

Referring to FIG. 6, wherein one side of the guide seat 3 is disposed of an inserting groove 31 to allow insertion of the shifting rod 211 of the lock core 21, and the other side of the guide seat 3 is disposed of a convex cylinder 30 at the center thereof. Two first curved slants 32 are disposed respectively at each of the two sides of the convex cylinder 30, and two first support parts 322 are formed at the two intersections of the two first curved slants 32 respectively.

Figure 7:
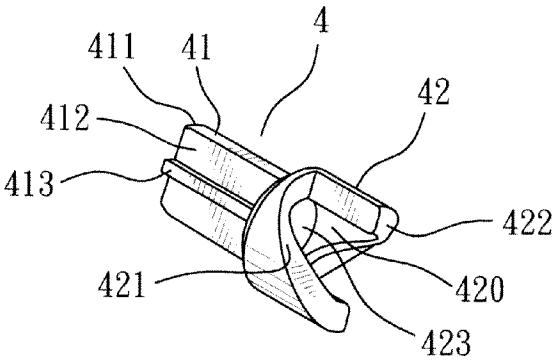
FIG. 7 is a perspective view of the lock tongue seat according to the present invention.

Please refer to FIG. 7, wherein the lock tongue seat 4 has a lock tongue 41 outstretching from one side and a seat body 42 at the other side thereof. The outer surface 410 of the lock tongue 41 has an arc chamfer 411 at the front end thereof, and the inner surface of the lock tongue 41 is disposed of a guide rib 413. The seat body 42 has a hollow chamber 420, wherein a concave hole 423 is disposed at the center of the hollow chamber 420 to allow insertion of the convex cylinder 30 of the guide seat 3. Two corresponding second curved slants 421 are arranged at the peripheral edge of the hollow chamber 420, wherein two second support parts 422 are formed respectively at the two intersections of the two second curved slants 421. The two second support parts 422 further abut against the first curved slants 32 of the guide seat 3.

The spring 5 fits with the lock tongue 41 of the lock tongue seat 4 and the position-limiting actuates between the hook cylinder 6 and the lock tongue seat 4.

Figure 8:
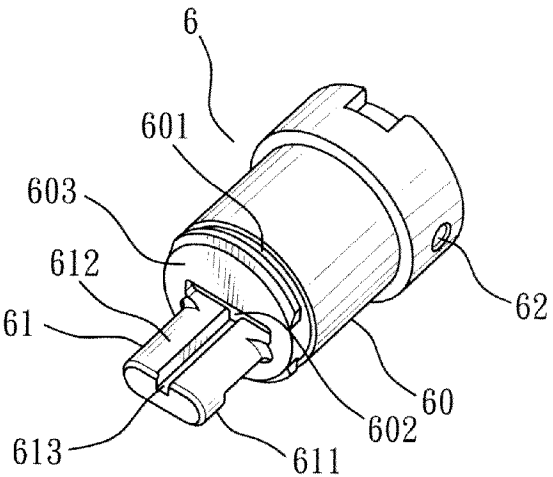
FIG. 8 is a perspective view of the hook cylinder according to the present invention.

Referring to FIG. 8, wherein the hook cylinder 6 has a main body 60 disposed of a front cylinder 61 at one side thereof. A hook part 611 is outstretching from edge of the front cylinder 61's outer surface 610, and inner surface 612 of the front cylinder 61 is further disposed of a guide groove 613 to allow the guide rib 413 of the lock tongue seat 4 to wedge and slide therein. The main body 60 of the hook cylinder 6 is disposed of a wedging groove 601 to allow insertion of a C-shaped elastic fastener C. The other side of the hook cylinder 6 is concavely disposed of a receiving space 63, wherein a through hole 602 penetrates the bottom of the receiving space 63 to allow insertion of the lock tongue 41. The receiving space 63 contains the spring 5, the lock tongue seat 4 and the guide seat 3. At least one second pin hole 62 corresponding to the first pin hole 222 is disposed at the peripheral edge of the hook cylinder 6, wherein the second pin hole 62 allows the insertion of the pin 223 when the hook cylinder 6 fits with the lock casing 22.

The cable rope set 7 is a ring seat 71 connected to a rope body 72, wherein the ring seat 71 has a penetrating hole 711 to allow the ring seat 71 to fit with the peripheral edge of the main body 60 of the hook cylinder 6. The peripheral edge of the ring seat 71 is further disposed of an embedding seat 712, wherein the embedding seat 712 has an embedding hole 713 thereon to allow an embedding head 721 on one end of the rope body 72 to be embedded therein. The other end of the rope body 72 is fixed with a fastening piece 73 to form a loop 722, as illustrated in FIG. 4, and a fixing strip 74 fits with the rope body 72 thereof. The fixing strip 74 allows the rope body 72 to attach to objects such as table legs or pillars in order to avoid entanglement thereof.

The main body 60 of the hook cylinder 6 has an end surface 603, wherein a soft pad body 8 can be flatly disposed on the end surface 603 to reduce the contact friction between the computer lock A and surface 93 of computer casing 9, allowing a tighter attachment therebetween.

Figure 10:
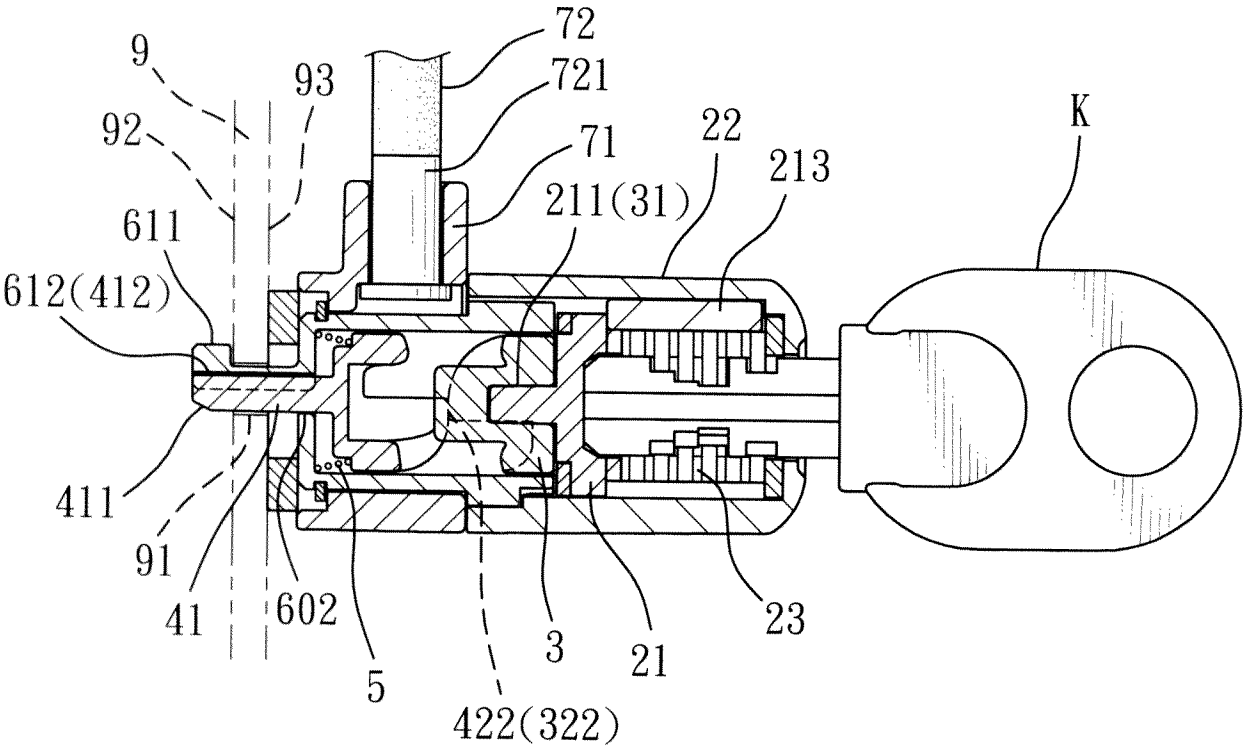
FIG. 10 is a second operating view of the present invention.

With reference to FIG. 9, to lock up the computer with the computer lock A of the present invention, insert the front cylinder 61 of the hook cylinder 6 into a slot 91 of the computer casing 9; insert and rotate the key K to turn the guide seat 3 for 180 degrees, actuate the second support part 422 of the lock tongue seat 4 to move along the first curved slant 32 from the lowest section 321 thereof to the first support part 322. The spring 5 is thereby being compressed, and the lock tongue 41 outstretch through the through hole 602 along the guide groove 613 and block the slot 91 thereof, as shown in FIG. 10. The lock tongue 41 has an arc chamfer 411, and is hence capable of guiding the lock tongue 41 to enter the slot 91 and reducing the friction therebetween to complete the locking operation.

To unlock the computer lock A, insert the key K into the keyhole 221 and reversely rotate the key K to turn the guide seat 3 to reverse 180 degrees, and thereby actuate the second support part 422 of the lock tongue seat 4 to move along the first curved slant 32 to the lowest section 321 thereof. The spring 5 is no longer being compressed and the spring force push the lock tongue seat 4 to move backwards to withdraw the lock tongue 41 from the slot 91. And then the front cylinder 61 of the hook cylinder 6 is detached from the slot 91.

While the invention has been described with reference to a preferred embodiment thereof, it is to be understood that modifications or variations may be easily made without departing from the spirit of this invention, which is defined in the appended claims.

I claim:

1. A computer lock comprising:

at least one lock body, one guide seat, one lock tongue seat, one spring, one hook cylinder and one cable rope set wherein:

the lock body comprises a lock core, a lock casing and a lock control set; a lock control chamber is disposed inside the lock core to contain the lock control set and the lock core fits with an inner chamber disposed inside the lock casing, and the front side of the lock core is further formed with a shifting rod;

the guide seat is formed with an inserting groove at one side to allow insertion of the shifting rod of the lock core; the other side of the guide seat is formed with a convex cylinder disposed at the center thereof, and two first curved slants are disposed respectively at each of the two sides of the convex cylinder;

the lock tongue seat has a lock tongue outstretching from a first side and a seat body at a second side thereof, wherein the seat body has a hollow chamber with a concave hole disposed at the center thereof to allow insertion of the convex cylinder of the guide seat; and two corresponding second curved slants are arranged at the peripheral edge of the hollow chamber to be slidably engaged by the curved slants of the guide seat, the lock tongue seat being thereby displaceable in an axial direction responsive to angular displacement of the guide seat thereabout;

the spring fits with the lock tongue of the lock tongue seat;

the hook cylinder includes a main body having a front cylinder at a first side and a receiving space at a second side thereof, wherein a hook part is outstretching from an edge of the front cylinder's outer surface, and a through hole penetrates the bottom of the receiving space to allow insertion of the lock tongue, the front cylinder maintaining slotted engagement with the lock tongue to guide linear displacement of the lock tongue in the axial direction therealong; the receiving space contains the spring, the lock tongue seat and the guide seat; and the cable rope set includes a ring seat connected to a rope body, wherein the ring seat has a penetrating hole to allow the ring seat to fit with the peripheral edge of the main body of the hook cylinder.

2. The computer lock as defined in claim 1, wherein a soft pad body is flatly disposed on the end surface of the main body of the hook cylinder.

3. The computer lock as defined in claim 1, wherein a guide groove is formed at an inner surface of the front cylinder to allow a guide rib of the lock tongue seat to wedge and slide therein.

4. The computer lock as defined in claim 1, wherein an outer surface of the lock tongue has an arc chamfer at the front end thereof.

5. The computer lock as defined in claim 1, wherein the main body of the hook cylinder is formed with a wedging groove to allow insertion of a C-shaped elastic fastener.

6. The computer lock as defined in claim 1, wherein a peripheral edge of the lock casing is formed with at least one first pin hole to allow insertion of at least one pin.

7. The computer lock as defined in claim 1, wherein a peripheral edge of the hook cylinder is formed with at least one second pin hole.

* * * * *